US005193775A

United States Patent [19]

Wagnon

[11] Patent Number: 5,193,775

[45] Date of Patent: Mar. 16, 1993

[54] ASSORTMENT OF WINDOW ADORNMENT MOUNTING BRACKETS

[76] Inventor: Gerald E. Wagnon, R.R. #1, Box 147, Great Bend, Kans. 67530

[21] Appl. No.: 856,467

[22] Filed: Mar. 24, 1992

[51] Int. Cl.[5] ..... A47H 1/10

[52] U.S. Cl. ..... 248/262; 160/330; 248/254

[58] Field of Search ..... 248/254, 262, 267, 251, 248/265, 270, 201, 216.1; 160/330; 52/37

[56] References Cited

U.S. PATENT DOCUMENTS

| | | | |
|---|---|---|---|
| 915,598 | 3/1909 | Hess | 248/258 |
| 1,063,800 | 6/1913 | Hughes | 248/262 X |
| 1,373,397 | 4/1921 | Arntz | 248/256 |
| 1,499,401 | 7/1924 | Packer | 248/256 |
| 3,049,327 | 8/1962 | Caudell | 248/265 X |
| 3,090,588 | 5/1963 | Monette | 248/262 X |
| 3,430,908 | 3/1969 | Kowalczyk | 248/265 |
| 4,167,261 | 9/1979 | Bartels | 248/270 |
| 4,961,296 | 10/1990 | Morehouse | 52/37 |
| 4,964,604 | 10/1990 | Lombard | 248/262 |
| 5,082,226 | 1/1992 | Mahan | 248/265 |

*Primary Examiner*—J. Franklin Foss

*Attorney, Agent, or Firm*—John R. Flanagan

[57] ABSTRACT

An assortment of mounting brackets for supporting window adornment attaching hardware adjacent to opposite upper corner portions and opposite side portions of a window molding attached to a wall and to a top portion of the window molding. The assortment of mounting brackets includes a pair of corner brackets, a pair of side brackets, and a top bracket. The corner brackets are capable of being mounted against portions of the wall located adjacent to the upper corner portions of the window molding and in frictionally fitted connections with and between the wall and angularly spaced side and top edges of the respective upper corner portions of the window molding. The side brackets are capable of being mounted against portions of the wall adjacent to the side portions of the window molding and in frictionally fitted connections with and between the wall and edges of the side portions of the window molding. The top bracket is capable of being mounted against the top portion of the window molding and in a frictionally fitted connection with and between the wall and an edge of the top portion of the window molding.

11 Claims, 2 Drawing Sheets

ASSORTMENT OF WINDOW ADORNMENT MOUNTING BRACKETS

BACKGROUND OF THE INVENTION

1. Field of the Invention

The present invention generally relates to devices for hanging window adornments, such as curtains, drapes and shades, and, more particularly, is concerned with an assortment of window adornment mounting brackets.

2. Description of the Prior Art

Window adornments, such as curtains, drapes and shades, have historically been attached to window molding or to the wall located beside the window molding through fastening attaching hardware for the adornments to the window molding or the walls by using nails or screws. Nailing or screwing the attaching hardware to the window molding or to the adjacent wall has the detrimental effect of leaving unsightly holes in molding or wall and, if care is not exercised, can even cause splitting of pieces of the window molding.

A curtain mounting bracket is disclosed in U.S. Pat. No. 4,964,604 to Lombard which seeks to overcome these problems. The Lombard mounting bracket is designed to be attachable over an upper corner of the window molding without the use of mounting nails or screws. The Lombard mounting bracket is constructed to have a flat base for positioning against the front face of the window molding corner where one end of the curtain is to be hung and a curtain bracket support hook extending forwardly from the flat base to receive one end of the curtain hanger. The mounting bracket also is constructed to have a pair of top and side bracket support members attached respectively to an upper end and one of the lateral edges of the flat base and extending rearwardly therefrom through distances which match the thickness of the top and side of the window molding. The top and side bracket support members of the mounting bracket further have respective downwardly and inwardly projecting rear ears or prongs on the rear ends thereof. The mounting bracket is installed by, first, placing the top and side bracket support members in alignment with the top and side of the window molding corner, next, driving the mounting bracket laterally toward the corner side until the side prong is fully inserted between the wall and the rear side of the window molding and, finally, driving the mounting bracket downwardly toward the corner top until the top prong is fully inserted between the wall and rear side of the window molding.

The Lombard mounting bracket appears to solve the problem of creating unsightly holes in the window molding and of possibly splitting pieces of the window molding. However, the manner of installing the mounting bracket, as well as the manner of removing the mounting bracket, are likely to cause abrasive rubbing and scratching of the front face of the window molding corner by the rear face of the flat base of the Lombard mounting bracket. This seems to be the case because during installing of the mounting bracket, by driving it first laterally inwardly and then downwardly, the rear face of the flat base is in sliding contact with the front face of the window molding corner. Such sliding contact between the flat base of the mounting bracket and the front face of the molding is more than likely to cause scratching and maring of the front face of the window molding. Further, the Lombard mounting bracket employs a curtain rod hook of a specific design and so does not utilize nor accommodate the different configurations of attaching hardware which are supplied with the various window adornment hanging systems.

Consequently, a need still remains for an improved mounting bracket design which continues to avoid the necessity to make nail or screw holes to attach it, but which at the same time does not introduce or substitute some other blemish-generating contact with the front face of the window molding and is capable of accommodating the different attaching hardware commercially distributed with the various window adornment hanging systems.

SUMMARY OF THE INVENTION

The present invention provides an assortment of window adornment mounting brackets designed to satisfy the aforementioned needs. The mounting brackets of the present invention makes it much simpler to install window adornments, such as curtains, drapes and shades, by enabling an ordinary person to quickly install the desired ones of the mounting brackets without using nails or screws, to easily maintain a level attitude with each installation, and to readily and correctly secure the various attaching hardware to the installed mounting brackets without the need to use of any tool. The mounting brackets can be installed with only a few taps from a lightweight hammer to drive the respective anchoring portions into place between the window molding and the wall. No nails, screws or other types of surface penetrating devices are used for securing the mounting brackets to the window molding or to the wall. The mounting brackets do not make sliding contact with the front face of the window molding and so are incapable of marring the front face thereof during installation or removal.

Accordingly, the present invention is directed to an assortment of window adornment mounting brackets which includes a pair of corner brackets, a pair of side corner portions and opposite side portions of a window molding attached to a wall and to a top portion of the window molding. The assortment of mounting brackets includes a pair of corner brackets, a pair of side brackets, and a top bracket. The corner brackets are capable of being mounted in flush contact with portions of the wall adjacent to the upper corner portions of the window molding and of making a frictionally fitted connection between the wall portions and angularly spaced side and top edges of the respective upper corner portions of the window molding. The side brackets are capable of being mounted in flush contact with portions of the wall adjacent to the side portions of the window molding and of making a frictionally fitted connection between the wall portions and edges of the side portions of the window molding. The top bracket is capable of being mounted over a top portion of the window molding and of making a frictionally fitted connection between the wall and an edge of the top portion of the window molding.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
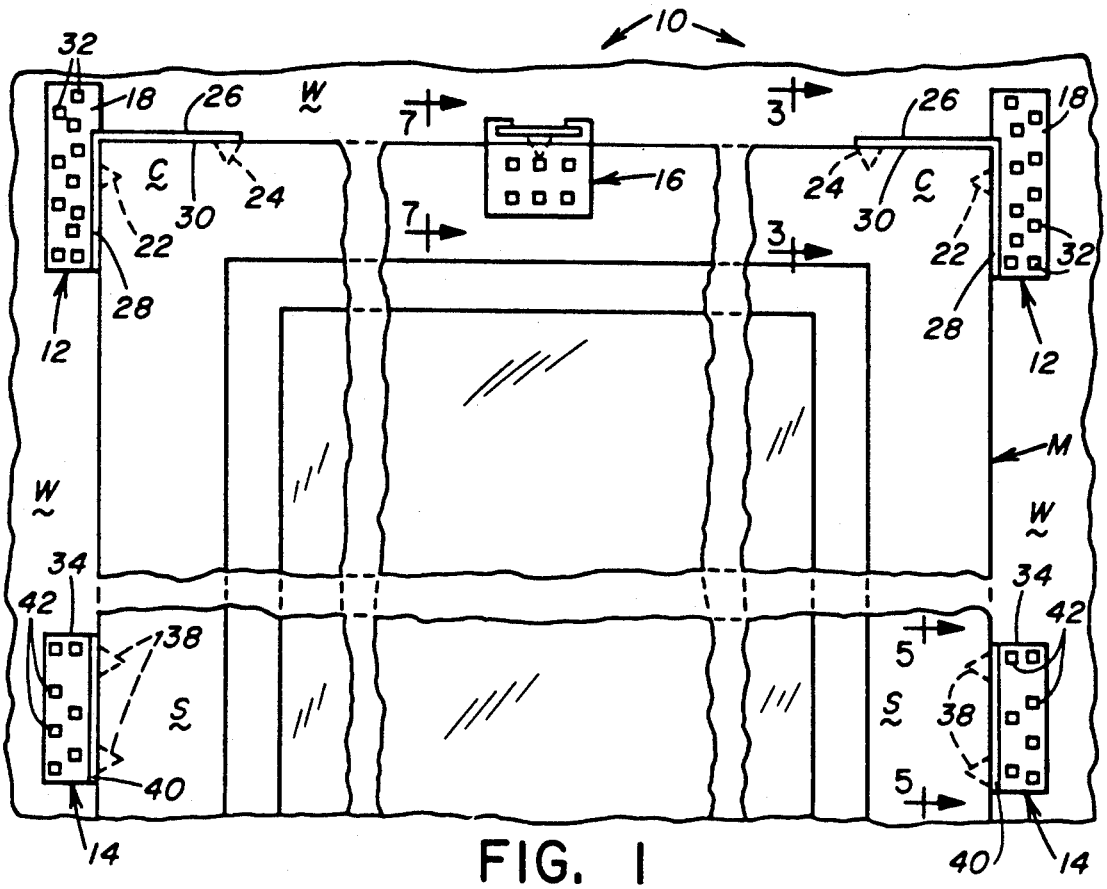
FIG. 1 is a front view of an assortment of window adornment mounting brackets of the present invention installed about the periphery of the molding of a window frame being shown in fragmentary and foreshortened form.

Referring to FIG. 1 of the drawings, there is illustrated an assortment of mounting brackets of the present invention, generally designated 10, for supporting window adornment attaching hardware adjacent to opposite upper corner portions C and opposite side portions S of a window molding M attached to a wall W and to a top portion T of the window molding M. The assortment of mounting brackets 10 includes a pair of corner brackets 12, a pair of side brackets 14, and a top bracket 16. The corner brackets 12 are capable of being mounted against, or in relatively flush contact with, portions of the wall adjacent to the upper corner portions C of the window molding M and in frictionally fitted connections with and between the wall portions and angularly spaced side and top edges of the respective upper corner portions C of the window molding M. The side brackets 14 are capable of being mounted against, or in relatively flush contact with, portions of the wall adjacent to the side portions S of the window molding M and in frictionally fitted connections with and between the wall portions and edges of the side portions S of the window molding M. The top bracket 16 is capable of being mounted against, or in relatively flush contact with, the top portion T of the window molding M and in a frictionally fitted connection with and between the wall and an edge of the top portion T of the window molding M.

Figure 3:
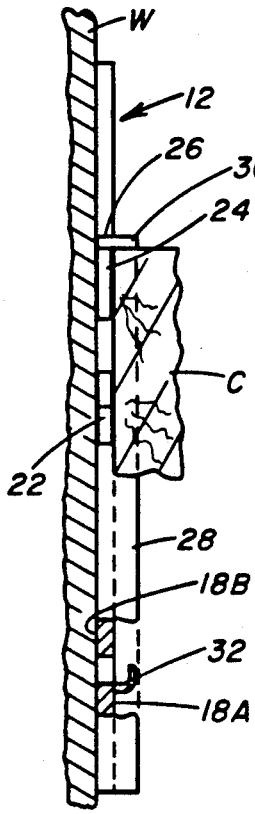
FIG. 3 is an enlarged side elevational view of the right corner bracket taken along line 3—3 of FIG. 1.
Figure 2:
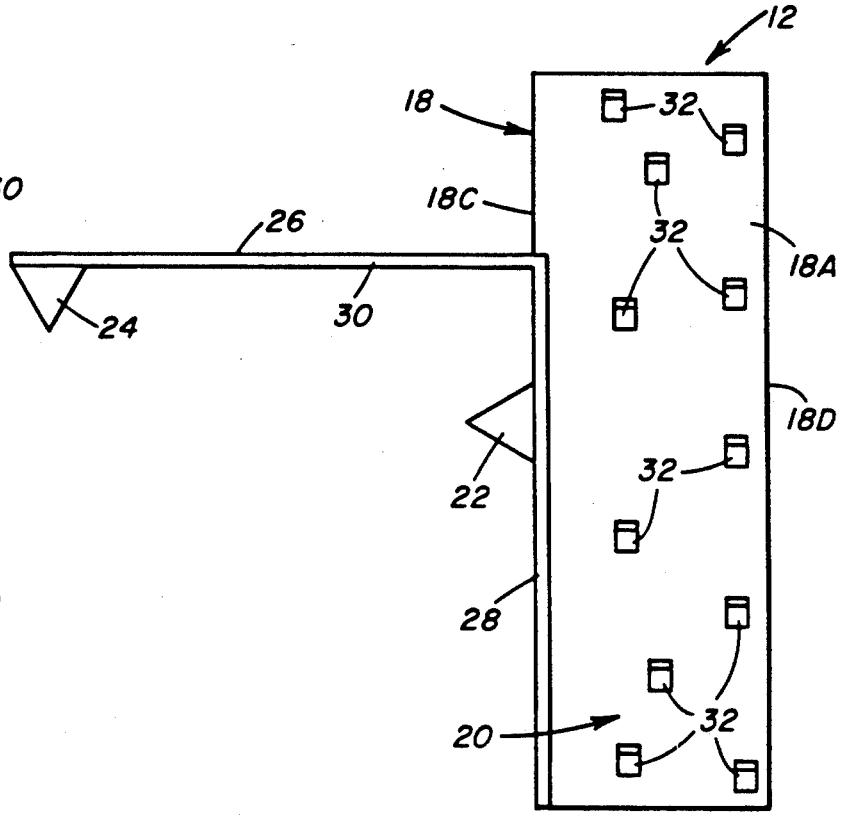
FIG. 2 is an enlarged front elevational view of a right one of a pair of corner brackets of FIG. 1 removed from the window molding.

Referring to FIGS. 1-3, each corner bracket 12 includes a flat base plate 18, attaching hardware mounting means 20, a pair of anchoring elements 22, 24, an elongated arm 26, and first and second means in the form of first and second lips 28, 30 respectively integrally attached on the base plate 18 and arm 26. The flat base plate 18 has opposite front and rear faces 18A, 18B and opposite side edges 18C, 18D. The flat base plate 18 is mountable adjacent to the respective corner portion C of the window molding M with its one side edge 18C disposed adjacent the corner portion C of the window molding M and with its rear face 18B disposed against a portion of the wall W located adjacent to the corner portion C of the window molding M. The means 20 on the base plate 18 for mounting a variety of window adornment attaching hardware (not shown) to the front face 18A of the base plate 18 is a plurality of spaced apart hook-like elements 32. The hook-like elements 32 are integrally attached to and project outwardly from the front face 18A of the base plate 18.

The anchoring elements 22, 24 are configured to insert and make frictionally fitted connections with and between the respective side and top edges of the corner portion C of the window molding M and the wall W. One anchoring element 22 is rigidly connected to and projects from the one side edge 18C of the base plate 18. The elongated arm 26 is rigidly connected to the one side edge 18C of the base plate 18 and projects therefrom in a substantially coplanar relationship with the base plate 18. The other anchoring element 24 is rigidly connected to and projects from the elongated arm 26. The elongated arm 26 thus disposes the other anchoring element 24 in an angularly displaced relationship from the one anchoring element 22. The anchoring elements 22, 24 are preferably flat pointed prongs which project in a substantially coplanar relationship with one another and with the flat base plate 18.

The first lip 28 on the base plate 18 is integrally connected to and extends along the one side edge 18C of the base plate 18 and projects in a substantially tranverse relationship to the plane of the flat base plate 18. In such configuration, the first lip 28 defines a limit or stop which determines the distance to which the one anchoring element 22 can be inserted between the side edge of the corner portion C of the window molding M and the wall W into the frictionally fitted connection therewith in order to thereby retain the flat base plate 18 adjacent to the corner portion C of the window molding M with the rear face 18B thereof disposed against the wall portion located adjace it to the corner portion C of the window molding M.

The second lip 30 is integrally connected to and extends along the elongated arm 26 and projects in a substantially transverse relationship to the plane of the elongated arm 26. In such configuration, the second lip 30 defines a limit or stop which determines the distance to which the other anchoring element 24 can be inserted between the top edge of the top portion T of the window molding M and the wall W into the frictionally fitted connection therewith in order to thereby retain the flat base plate 18 adjacent to the corner portion C of the window molding M with the rear face 18B thereof disposed against the wall portion located adjacent to the corner portion C of the window molding M.

Figure 5:
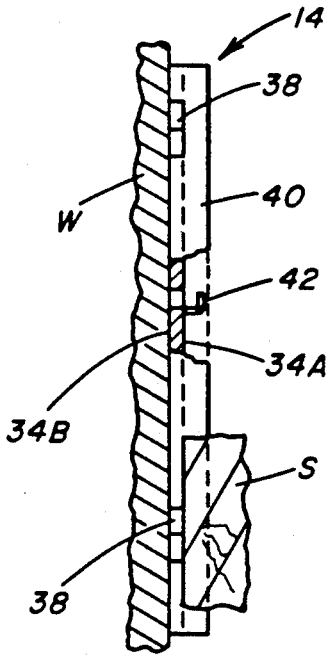
FIG. 5 is an enlarged side elevational view of the right side bracket taken along line 5—5 of FIG. 1.
Figure 4:
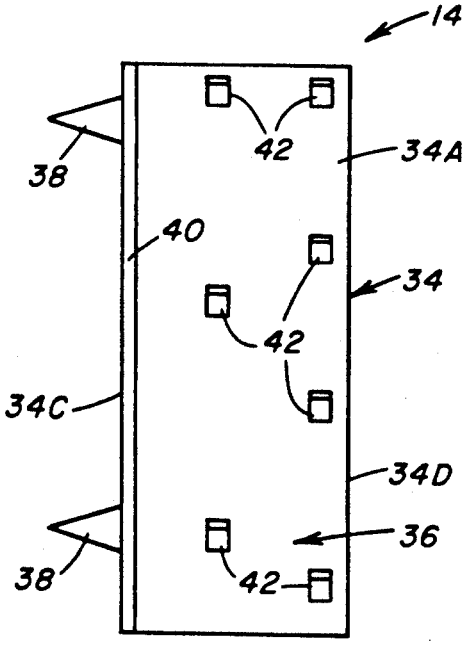
FIG. 4 is an enlarged front elevational view of a right one of a pair of side brackets of FIG. 1 removed from the window molding.

Referring to FIGS. 4 and 5, each side bracket 14 includes a flat base plate 34, attaching hardware mounting means 36, a pair of anchoring elements 38, and means in the form of a lip 40 on the base plate 18. The flat base plate 34 has opposite front and rear faces 34A, 34B and opposite side edges 34C, 34D. The flat base plate 34 is mountable adjacent to the respective side portion S of the window molding M with its one side edge 34C disposed adjacent to the side portion S of the window molding M and with its rear face 34B disposed against a portion of the wall located adjacent to the side portion S of the window molding M. The means 36 on the base plate 34 for mounting a variety of conventional window adornment attaching hardware (not shown) to the front face 34A of the base plate 34 is a plurality of spaced apart hook-like elements 42. The hook-like elements 42 are integrally attached to and project outwardly from the front face 34A of the base plate 18.

The anchoring elements 38 are configured to insert and make frictionally fitted connections with and between the edge of the side portion S of the window molding M and the wall W. Both anchoring elements 38 are spaced apart from one another along and rigidly connected to the one side edge 34C of the flat base plate 34. The anchoring elements 38 are preferably flat pointed prongs which project in a substantially coplanar relationship with one another and with the flat base plate 34.

The lip 40 on the flat base plate 34 is integrally connected to and extends along the one side edge 34C of the base plate 34 and projects in a substantially transverse relationship to the plane of the flat base plate 34. In such configuration, the lip 40 defines a limit or stop which determines the distance to which the anchoring elements 38 can be inserted between the edge of the side portion S of the window molding M into the frictionally fitted connections therewith in order to thereby retain the flat base plate 34 adjacent to the side portion S of the window molding M with the rear face 34B thereof disposed against the wall portion location adjacent to the side portion S of the window molding M.

Figure 7:
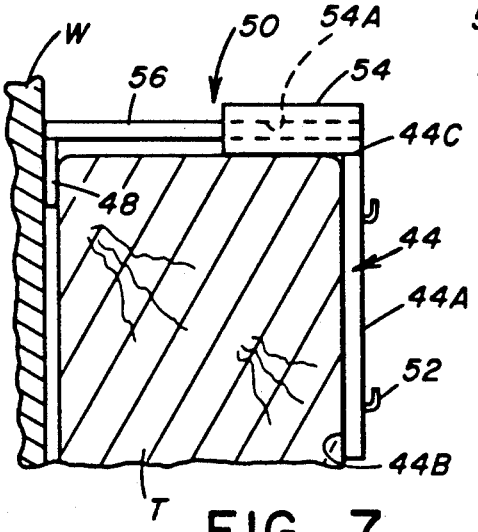
FIG. 7 is an enlarged side elevational view of the top bracket taken along line 7—7 of FIG. 1.
Figure 6:
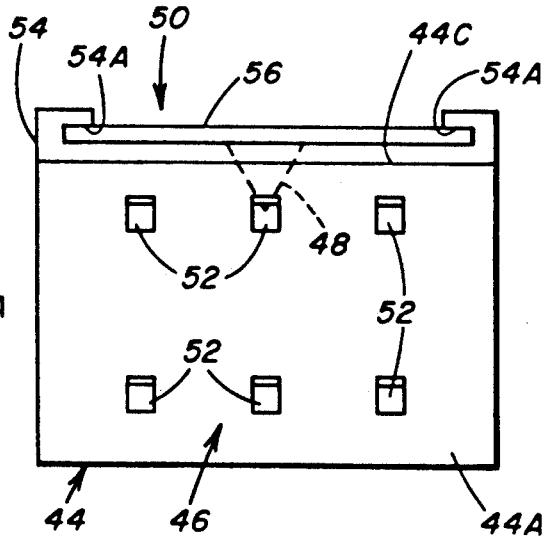
FIG. 6 is an enlarged side elevational view of a top bracket of FIG. 1 removed from the window molding.

Referring to FIGS. 6 and 7, the top bracket 16 includes a flat base plate 44, attaching hardware mounting means 46, at least one anchoring element 48, and adjustable means 50 interconnecting the base plate 44 and anchoring element 48. The flat base plate 44 has opposite front and rear faces 44A, 44B and is mountable with its rear face 44B disposed against a front side of the top portion T of the window molding M. The means 46 on the base plate 44 for mounting conventional window adornment attaching hardware (not shown) to the front face 44A of the base plate 44 is a plurality of spaced apart hook-like elements 52. The hook-like elements 52 are integrally attached to and project outwardly from the front face 44A of the base plate 44.

The anchoring element 48 is configured to insert and make a frictionally fitted connection with and between a top edge of the top portion T of the window molding M and the wall W. The anchoring element 48 is preferably a flat pointed prong which projects in a plane which is substantially parallel to the plane of the flat base plate 44.

The means 50 which interconnects an upper edge 44C of the flat base plate 44 and the anchoring element 48 is slidably adjustable to mount over the top edge of the top portion P of the window molding M with the anchoring element 48 disposed in the frictionally fitted connection between the top edge of the top portion P of the window molding M and the wall W and the rear face 44B of the base plate 44 disposed against, or in a flush contact with, the front side of the top portion T of the window molding M. The slidably adjustable means 50 is includes a first member 54 connected to the upper edge 44C of the flat base plate 44 and defining a slot 54A which extends generally parallel to the upper edge 44C. The means 50 also includes a second member 56 connected to the anchoring member 48 and defining a tongue insertable into and along the slot 54A to make a frictionally fitted slidable connection with the first member 54 for adjusting the distance between the anchoring member 48 and the flat base plate 44 to match the thickness of the top portion T of the window molding M.

The consumer purchases the assortment of mounting brackets 10 and then selects which of the brackets will used for any given application. The corner, side and top brackets 12, 14 and 16 are preferably constructed by using conventional fabrication techniques, from any suitable material, such as extruded aluminum or a stamped and formed metal. The consumer does not need to have any particular degree of skill in order to be able to quickly install the desired ones of the mounting brackets and to readily secure the various attaching hardware to the installed mounting brackets without the use of any tool. The mounting brackets can be installed with only a few taps from a lightweight hammer to drive the respective flat prongs of the brackets into frictional fitted connecting relationships between the window molding and the wall. No nails, screws or other types of surface penetrating devices are used for securing the mounting brackets to the window molding or to the wall.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. An assortment of mounting brackets for supporting window adornment attaching hardware adjacent to opposite upper corner portions, opposite side portions and a top portion of a window molding attached on a wall, said assortment of mounting brackets comprising:

(a) a pair of corner brackets capable of being mounted against portions of the wall adjacent to opposite upper corner portions of the window molding and in frictionally fitted relationship between the wall portions and angularly spaced side and top edges of the respective upper corner portions of the window molding;

(b) a pair of side brackets capable of being mounted against portions of the wall adjacent to opposite side portions of the window molding and in frictionally fitted relationship between the wall portions and edges of the side portions of the window molding; and (c) a top bracket capable of being mounted against a top portion of the window molding and in frictionally fitted relationship between the wall and an edge of the top portion of the window molding;

(d) said each corner bracket including (i) a flat base plate having opposite front and rear faces and a pair of opposite side edges and being mountable adjacent to one of the corner portions of the window molding with one of said opposite side edges disposed adjacent the side edge of the one corner portion of the window molding and with said rear face disposed against the wall portion adjacent to the side edge of the one corner portion of the window molding, (ii) means on said base plate for mounting window adornment attaching hardware to said front face of said base plate, (iii) a pair of anchoring elements configured to insert and make frictionally fitted connections between the one corner portion of the window molding and the wall, one of said anchoring elements being rigidly connected to and projecting from said one side edge of said base plate, (iv) an elongated arm rigidly connected to said one side edge of said base plate and projecting therefrom in a substantially coplanar relationship with said base plate, the other of said anchoring element being rigidly connected to and projecting from said elongated arm and and disposed in an angularly displaced relationship from said one anchoring element, (v) first means connected to and extending along aid one side edge of said base plate and projecting in a substantially tranverse relationship to said base plate for defining a limit to which said one anchoring element can be inserted into said frictionally fitted connection between the side edge of the one corner portion of the window molding and the wall in order to thereby retain said base plate adjacent to the one corner portion of the window molding with said rear face thereof disposed against the wall portion adjacent to the one corner portion of the window molding, and (vi) second means connected to and extending along said elongated arm and projecting in a substantially transverse relationship to said elongated arm for defining a limit to which said other anchoring element can be inserted into said frictionally fitted connection between the top edge of the one corner portion of the window molding and the all in order to thereby retain said base plate adjacent to the one corner portion of the window molding with said rear face thereof disposed against the wall portion adjacent to the one corner portion of the window molding.

2. The bracket assortment of claim 1 wherein said anchoring elements of said corner brackets are flat prongs which project in a substantially coplanar relationship with one another and with said base plate.

3. An assortment of mounting brackets for supporting window adornment attaching hardware adjacent to opposite upper corner portions, opposite side portions and a top portion of a window molding attached on a wall, said assortment of mounting brackets comprising:

(a) a pair of corner brackets capable of being mounted against portions of the wall adjacent to opposite upper corner portions of the window molding and in frictionally fitted relationship between the wall portions and angularly spaced side and top edges of the respective upper corner portions of the window molding;

(b) a pair of side brackets capable of being mounted against portions of the wall adjacent to opposite side portions of the window molding and in frictionally fitted relationship between the wall portions and edges of the side portions of the window molding; and (c) a top bracket capable of being mounted against a top portion of the window molding and in frictionally fitted relationship between the wall and an edge of the top portion of the window molding;

(d) said each corner bracket including (i) a flat base plate having a pair of opposite front and rear faces and a pair of opposite side edges, said base plate being mountable adjacent to one of the side portions of the window molding with one of said side edges disposed adjacent to the one side portion of the window molding and with said rear face disposed against the wall portion adjacent to the one side portion of the window molding, (ii) means on said base plate for mounting window adornment attaching hardware to said front face of said base plate, (iii) a pair of anchoring elements spaced apart along, rigidly connected to, and projecting from said one side edge of said base plate, said anchoring elements being configured to insert and make frictionally fitted connections between a side edge of the one side portion of the window molding and the wall, and (iv) means connected to and extending along said one side edge of said base plate and projecting substantially tranversely to said base plate for defining a limit to which said anchoring elements can be inserted into the frictionally fitted connections between the side edge of the one side portion of the window molding and the wall in order to thereby retain said base plate adjacent to the one side portion of the window molding with said rear face thereof disposed against the wall portion adjacent to the one side portion of the window molding.

4. The bracket assortment of claim 3 wherein said anchoring elements of said side brackets are flat prongs which project in a substantially coplanar relationship with one another and with said base plate.

5. An assortment of mounting brackets for supporting window adornment attaching hardware adjacent to opposite upper corner portions, opposite side portions and a top portion of a window molding attached on a wall, said assortment of mounting brackets comprising:

(a) a pair of corner brackets capable of being mounted against portions of the wall adjacent to opposite upper corner portions of the window molding and in frictionally fitted relationship between the wall portions and angularly spaced side and top edges of the respective upper corner portions of the window molding;

(b) a pair of side brackets capable of being mounted against portions of the wall adjacent to opposite side portions of the window molding and in frictionally fitted relationship between the wall portions and edges of the side portions of the window molding; and (c) a top bracket capable of being mounted against a top portion of the window molding and in frictionally fitted relationship between the wall and an edge of the top portion of the window molding;

(d) said top bracket including (i) a flat base plate having opposite front and rear faces and being mountable with said rear face disposed against a top portion of the window molding, (ii) means on said base plate for mounting window adornment attaching hardware to said front face of said base plate, (iii) at least one anchoring element configured to insert and make a frictionally fitted connection between a top edge of the top portion of the window molding and the wall, and (iv) means interconnecting an upper edge of said base plate to said anchoring element and being slidably adjustable to mount over the top edge of the top portion of the window molding with said anchoring element disposed in the frictionally fitted connection between the top edge of the top portion of the window molding and the wall to thereby retain said base plate with said rear face thereof disposed against the top portion of the window molding.

6. The bracket assortment of claim 5 wherein said anchoring element of said top bracket is a flat prong projecting in a plane substantially parallel to the plane of said base plate.

7. The bracket assortment of claim 5 wherein said slidably adjustable interconnecting means includes:

a first member connected to one of said base plate and said anchoring member and defining a slot; and a second member connected to the other of said base plate and said anchoring member and defining a tongue insertable into said slot so as to make a frictionally fitted slidable connection with said first member for adjusting the distance between said anchoring member and said base plate.

8. A corner bracket for supporting window adornment attaching hardware adjacent to a corner portion of a window molding attached on a wall, said corner mounting bracket comprising:

(a) a flat base plate having opposite front and rear faces and a pair of opposite side edges and being mountable adjacent to a corner portion of the window molding with one of said side edges disposed adjacent the corner portion of the window molding and with said rear face disposed against a portion of the wall located adjacent to the corner portion of the window molding;

(b) means on said base plate for mounting window adornment attaching hardware to said front face of said base plate;

(c) a pair of anchoring elements configured to insert and make frictionally fitted connections with and between the respective corner portion of the window molding and the wall, one of said anchoring elements being rigidly connected to said one side edge of said base plate and projecting therefrom;

(d) an elongated arm rigidly connected to said one side edge of said base plate and projecting therefrom in a substantially coplanar relationship with said base plate, the other of said anchoring elements being rigidly connected to said elongated arm and projecting therefrom and disposed in an angularly displaced relationship from said one anchoring elements;

(e) first means connected to and extending said one side edge of said base plate and projecting in a substantially tranverse relationship to said base plate for defining a limit to which said one anchoring element can be inserted into said frictionally fitted connection with and between a side edge of the corner portion of the window molding and the wall in order to thereby retain said base plate adjacent to the corner portion of the window molding with said rear face thereof disposed against the wall portion located adjacent to the corner portion of the window molding;

(f) second means connected to and extending along said elongated arm and projecting in a substantially transverse relationship to said elongated arm for defining a limit to which said other anchoring element can be inserted into said frictionally fitted connection with and between a top edge of the corner portion of the window molding and the wall in order to thereby retain said base plate adjacent to the corner portion of the window molding with said rear face thereof disposed against the wall portion located adjacent to the corner portion of the window molding.

9. The corner bracket of claim 8 wherein said anchoring elements are flat prongs which project in a substantially coplanar relationship with one another and with said base plate.

10. The corner bracket of claim 8 wherein said attaching hardware mounting means on said base plate is a plurality of spaced apart hook-like elements attached to and projecting outwardly from said front face of said base plate.

11. The corner bracket of claim 8 wherein said first and second limit-defining means are respective lips connected to, extending along, and projecting transversly from said respective one side edge of said base plate and said elongated arm.

* * * * *